US009494295B2

(12) United States Patent
Albrecht et al.

(10) Patent No.: US 9,494,295 B2
(45) Date of Patent: Nov. 15, 2016

(54) RING LIGHT MODULE

(71) Applicant: OSRAM Opto Semiconductors GmbH, Regensburg (DE)

(72) Inventors: Tony Albrecht, Bad Abbach (DE); Thomas Schlereth, Regensburg (DE); Roland Schulz, Regensburg (DE); Christian Gaertner, Regensburg (DE); Albert Schneider, Thalmassing (DE); Markus Kirsch, Brunn (DE); Michael Bestele, Lappersdorf (DE); Stefan Handl, Zell (DE)

(73) Assignee: OSRAM OPTO SEMICONDUCTOR GMBH, Regensburg (DE)

( * ) Notice: Subject to any disclaimer, the term of this patent is extended or adjusted under 35 U.S.C. 154(b) by 0 days.

(21) Appl. No.: 14/430,898

(22) PCT Filed: Sep. 17, 2013

(86) PCT No.: PCT/EP2013/069266
§ 371 (c)(1),
(2) Date: Mar. 24, 2015

(87) PCT Pub. No.: WO2014/048795
PCT Pub. Date: Apr. 3, 2014

(65) Prior Publication Data

US 2015/0247616 A1 Sep. 3, 2015

(30) Foreign Application Priority Data

Sep. 27, 2012 (DE) ..... 10 2012 109 145

(51) Int. Cl.
*F21V 7/04* (2006.01)
*F21K 99/00* (2016.01)
(Continued)

(52) U.S. Cl.
CPC . *F21V 7/04* (2013.01); *F21K 9/60* (2016.08); *F21V 7/0008* (2013.01); *F21V 13/04* (2013.01);
(Continued)

(58) Field of Classification Search
CPC ..... F21V 7/00; F21V 7/0008; F21V 7/0016; F21V 7/0058; F21V 7/0066; F21V 7/04; F21V 7/041; F21V 7/043; F21V 7/048; F21V 13/04; F21V 13/10; F21V 5/046; F21V 5/08; F21V 3/02; F21V 1/146; F21K 9/00; F21K 9/50
USPC ..... 362/35, 235
See application file for complete search history.

(56) References Cited

U.S. PATENT DOCUMENTS 7,891,840 B1 * 2/2011 Kang ..... F21K 9/00 362/249.02
2002/0105807 A1 * 8/2002 Loughrey ..... F21S 8/02 362/278

(Continued)

FOREIGN PATENT DOCUMENTS

DE 10153756 A1 4/2003
DE 102009006185 A1 7/2010

(Continued)

OTHER PUBLICATIONS

Barry Chadwick and Chris Toto, Radiolucent Structural Materials for Medical Applications, Jun. 1, 2001, http://www.mddionline.com/article/radiolucent-structural-materials-medical-applications.*

*Primary Examiner* — Renee Chavez
*Assistant Examiner* — Colin Cattanach
(74) *Attorney, Agent, or Firm* — McDermott Will & Emery LLP

(57) ABSTRACT

A ring light module having a plurality of optoelectronic semiconductor components for producing electromagnetic radiation, a reflector of the ring light module comprising a reflective surface, and a support. The semiconductor components are mounted on the support. In a plan view of a main radiation side of the ring light module, the reflector comprises at most two planes of symmetry. The reflector tapers in the direction towards the main radiation side. At least some of the main emission directions of adjacent optoelectronic semiconductor components are oriented differently from each other, and the main emission directions point towards the reflective surface.

16 Claims, 6 Drawing Sheets

(51) Int. Cl.

| | |
|---|---|
| ***F21V 13/04*** | (2006.01) |
| ***F21V 7/00*** | (2006.01) |
| ***F21V 13/10*** | (2006.01) |
| *F21V 9/16* | (2006.01) |
| *F21Y 101/00* | (2016.01) |

(52) U.S. Cl.
CPC ..... *F21V 13/10* (2013.01); *F21V 9/16* (2013.01); *F21Y 2101/00* (2013.01); *F21Y 2103/33* (2016.08)

(56) References Cited

U.S. PATENT DOCUMENTS

| | | | | |
|---|---|---|---|---|
| 2005/0135117 | A1 | 6/2005 | Lamb et al. | |
| 2007/0091281 | A1* | 4/2007 | Radominski | G03B 27/54 353/94 |
| 2007/0171676 | A1 | 7/2007 | Chang | |
| 2007/0217193 | A1* | 9/2007 | Lin | F21S 4/003 362/245 |
| 2007/0263388 | A1* | 11/2007 | Lai | F21S 8/086 362/287 |
| 2009/0086507 | A1 | 4/2009 | Iwasaki | |
| 2010/0172152 | A1* | 7/2010 | Boonekamp | F21V 7/0008 362/609 |
| 2010/0309646 | A1* | 12/2010 | Morikawa | F21K 9/00 362/84 |
| 2011/0007506 | A1* | 1/2011 | Kinoshita | G02B 6/0096 362/235 |
| 2011/0032698 | A1* | 2/2011 | Kim | F21V 7/0008 362/235 |
| 2011/0222267 | A1 | 9/2011 | Park et al. | |
| 2011/0273878 | A1* | 11/2011 | Venhaus | F21V 7/00 362/235 |
| 2011/0292638 | A1* | 12/2011 | Kwak | F21K 9/00 362/84 |
| 2012/0212956 | A1 | 8/2012 | Chen | |
| 2013/0176741 | A1* | 7/2013 | Nakamura | F21V 13/12 362/347 |

FOREIGN PATENT DOCUMENTS

| | | | |
|---|---|---|---|
| DE | 202011003261 | U1 | 4/2011 |
| DE | 102010046255 | A1 | 3/2012 |
| DE | 102012109146 | A1 | 3/2014 |
| EP | 1826474 | A1 | 8/2007 |
| EP | 2375133 | A2 | 10/2011 |
| EP | 2481971 | A1 | 8/2012 |
| JP | 11162234 | A | 6/1999 |
| KR | 20120049014 | A | 5/2012 |
| WO | 2009/098629 | A1 | 8/2009 |

* cited by examiner

A)

B)

RING LIGHT MODULE

TECHNICAL FIELD

A ring light module is provided.

BACKGROUND

Document DE 10 2010 046 255 A1 relates to an illumination apparatus.

Document US 2011/0222267 A1 describes a back-lighting device for display apparatuses.

SUMMARY

An object to be achieved resides in providing a compact ring light module comprising an adjustable directional characteristic and a high luminous density.

This object is achieved inter alia by a ring light module comprising the features of the independent claim. Preferred developments are described in the dependent claims.

In accordance with at least one embodiment, the ring light module comprises a plurality of optoelectronic semiconductor components. The semiconductor components are configured for generating an electromagnetic radiation. Preferably, the semiconductor components are light-emitting diodes. In particular, the semiconductor components are intended to emit visible light.

In accordance with at least one embodiment, the ring light module includes a reflector. The reflector comprises a reflective surface. The reflective surface is configured to reflect at least a portion of the radiation generated by the semiconductor components during operation and to adjust or co-adjust a directional characteristic of the ring light module.

Disregarding the semiconductor components themselves, the reflective surface can be the single optical, beam-forming component of the ring light module. The reflective surface can be radiopaque and can comprise a reflection coefficient for the radiation generated by the semiconductor components of at least 80% or of at least 90%. Equally, it is possible that the reflector becomes totally reflective for at least a portion of the radiation generated by the semiconductor components.

In accordance with at least one embodiment, the ring light module comprises a carrier. In this case, the semiconductor components are attached to the carrier. Preferably, the carrier comprises a high thermal conductivity and is suitable for transporting waste heat away from the semiconductor components during operation. Furthermore, the carrier preferably includes electrical strip conductors and electrical connection points for supplying current to and actuating the semiconductor components.

In accordance with at least one embodiment, the reflector, as seen in plan view of a main radiation side of the ring light module, comprises at the most two planes of symmetry. For example, the reflector is then formed in a mirror-symmetrical manner in relation to precisely one or in relation to precisely two planes of symmetry. It is possible that, as seen in plan view, the reflector does not comprise a plane of symmetry or a plane of mirror-symmetry.

In a variation thereof, the reflector and/or the reflective surface can be formed in a rotationally symmetrical manner and can comprise a common axis of symmetry together with the carrier and an arrangement pattern of the semiconductor components.

In particular, the main radiation side is the side of the ring light module, at which all or the majority of the generated radiation exits from the ring light module. The main radiation side can be a notional surface or a real surface.

In accordance with at least one embodiment, the reflector tapers in the direction towards the main radiation side. An average diameter or a circumferential line of the reflective surface thus decreases in the direction towards the main radiation side.

In accordance with at least one embodiment, the semiconductor components each comprise main emission directions. In particular, each of the semiconductor components comprises precisely one main emission direction. The main emission direction is e.g. the direction, along which a maximum luminous density is emitted.

In accordance with at least one embodiment, the main emission directions of adjacent semiconductor components point at least partly in mutually different directions. Preferably, the main emission directions each point towards the reflective surface, in particular towards a geometric centre point of the reflector, as seen in plan view. It is possible that all of the main emission directions are oriented differently from one another in pairs and point in each case towards the geometric centre of the reflector. In each case two of the main emission directions can be oriented antiparallel with respect to one another.

According to at least one embodiment, the ring light module comprises a plurality of optoelectronic semiconductor components for generating an electromagnetic radiation. A reflector of the ring light module comprises a reflective surface. The semiconductor components are attached to a carrier. As seen in plan view of a main radiation side of the ring light module, the reflector preferably comprises at the most two planes of symmetry. The reflector tapers in the direction towards the main radiation side. Main emission directions of adjacent semiconductor components are oriented at least in part differently from one another. The main emission directions point towards the reflective surface.

In order to achieve a high lighting current, it is technically expedient only to a certain degree to scale individual semiconductor components, such as light-emitting diodes, to larger optical output powers. In order to achieve a higher light power, a plurality of semiconductor modules are bundled to form modules. Since such a module is composed of a plurality of approximately point-shaped light sources, homogenisation of the directional characteristic is required for many applications. In particular, the light emitted by the module is to be as homogeneous as possible in terms of luminous colour and luminous density and is to extend monotonously over a largest possible angle range and is to comprise as few discontinuous points or sharp kinks as possible. Furthermore, the module is to comprise the smallest possible dimensions in order to permit a high lighting current and high efficiency.

In the case of conventional modules, this homogenisation is achieved in particular by means of diffuse optical elements. A diffuser material can be added to a volume casting or can be located in diffuser plates so that blending of the light emitted by the individual semiconductor components takes place. However, in this case multiple scattering generally occurs in the diffuser material, which can lead to a loss of efficiency and in general also increases the size of the angle of radiation of the module. In general, in order to maintain directive efficiency in spite of the use of a diffuser it is necessary to use comparatively complex reflectors which can also lead to a loss of efficiency. The aforementioned difficulties occur in particular in the case of semiconductor components which are arranged in a planar manner and whose emission directions are oriented in parallel with one another.

The annular arrangement of the semiconductor components and the non-planar reflector permit homogenisation of the radiation of the ring light module without requiring a separate diffuser. Furthermore, a directivity of the radiation of the semiconductor components is retained and is not expanded by a diffuser. Moreover, a compact arrangement having a high luminous density is possible.

Furthermore, the reflector which in particular is not formed in a rotationally symmetrical manner renders it possible to adjust the radiation pattern efficiently. Such ring light modules comprising an asymmetrical directional characteristic can be used e.g. for street lighting, projection purposes or as headlights in the automotive industry as particularly switchable headlights with a dipped setting, full beam setting and/or daytime driving setting. So-called linear retrofits which imitate an external shape for instance of fluorescent tubes can also be achieved by such adapted reflectors.

The ring light module can be used to achieve e.g. linear illumination patterns for instance for retrofits, rectangular illumination patterns for instance for street lighting, elliptical illumination patterns or club-shaped illumination patterns for example for footpath lighting. Equally, it is possible during operation to switch between different illumination patterns.

In accordance with at least one embodiment, the semiconductor light sources are arranged in a rotationally symmetrical manner around the reflector, as seen in plan view of the main radiation side. For example, the semiconductor light sources are then located on a circular line. This circular line can completely or at least partly include the reflector and/or the reflective surface, as seen in plan view of the main radiation side. This circular line then constitutes an arrangement line of the semiconductor components.

In accordance with at least one embodiment, the semiconductor light sources are arranged close together along the preferably circular arrangement line. This can mean that an average spaced interval between adjacent semiconductor components is at the most three times or at the most twice or at the most equal to or at the most 0.75 times an average diameter of the semiconductor components, approximately in a plane perpendicular to the main emission direction. Alternatively or in addition, the average spaced interval is at the most 3.5 mm or at the most 5.5 mm. As a result, it is possible to achieve particularly high luminous densities.

In accordance with at least one embodiment, the arrangement line is a closed line. For example, the arrangement line is then formed by a circular line or by an ellipse. Equally, the arrangement line can be a regular or irregular, closed polygon, e.g. having at least eight sides or having at least twelve sides. Alternatively, it is possible that the arrangement line is an open line, e.g. helical, or that the semiconductor components are arranged in a plurality of closed arrangement lines. This is possible e.g. in the form of a plurality of annular arrangement lines stacked one on top of the other.

In accordance with at least one embodiment, the carrier is formed in a rotationally symmetrical manner, as seen in plan view of the main radiation side. For example, the carrier then comprises a basic cylindrical shape and/or can be designed in a tubular manner.

In accordance with at least one embodiment, the semiconductor components are arranged in two or more than two arcs around the reflector. The arcs can be partial circular arcs. That is to say that within one of the arcs a radius does not then change, in particular as seen in plan view of the main radiation side.

In accordance with at least one embodiment, the partial circular arcs are spaced apart from one another and the semiconductor components are arranged close together within the partial circular arcs. In other words, a spaced interval of adjacent semiconductor components within one of the arcs can be smaller than a spaced interval between adjacent semiconductor components of two adjacent arcs.

In accordance with at least one embodiment, the arcs comprise the same axis of rotation and/or the same axis of symmetry as the carrier, as seen in plan view of the main radiation side. For example, the carriers and the arcs then comprise the same centre of a circle and in particular different radii, as seen in plan view.

In accordance with at least one embodiment, the arcs extend in an angle range of at least 30° or at least 60° or at least 90° around a centre point. Alternatively or in addition, this angle range is at the most 160° or at the most 135° or at the most 120°.

In accordance with at least one embodiment, the ring light module comprises one or a plurality of screens, also referred to as diaphragm. The at least one screen is configured for retaining at least a portion of the radiation emitted by the semiconductor components. The screen can be designed to be reflective or absorbing. It is possible that the screen is designed to be absorbing or reflective only for a specific spectral range of the radiation generated by the semiconductor components and functions in a transmitting manner for other spectral ranges. A directional characteristic of the ring light module can be adjusted in a simple manner by such screens.

In accordance with at least one embodiment, some of the semiconductor components or all of the semiconductor components are completely or partly covered by the screen, as seen in plan view of the main radiation side. The screen can prevent radiation generated by the semiconductor components from exiting the ring light module without experiencing a deflection of the beam path at the screen, the carrier and/or the reflector.

In accordance with at least one embodiment, as seen in plan view of the main radiation side, the screen is not formed in a rotationally symmetrical manner and comprises at the most one or at the most two planes of symmetry. Alternatively, it is possible for the screen to also be designed in a rotationally symmetrical manner, as seen in plan view.

In accordance with at least one embodiment, the screen is segmented. That is to say, the screen then does not frame the reflector continuously at a uniform width but rather comprises restrictions or complete interruptions. The screen can be designed in multiple parts or even in one piece. In particular, the screen then does not cover all of the semiconductor components, as seen in plan view of the main radiation side.

In accordance with at least one embodiment, the semiconductor components or groups of semiconductor components can be electrically operated independently of one another. As a result, it is possible that a spatial directional characteristic and/or a spatial intensity distribution and/or a spectral directional characteristic of the ring light module can be adjusted by selectively operating at least some of the semiconductor components. For example, such a ring light module can switch between a dipped setting and daytime driving setting electronically and without any mechanical, movable components.

In accordance with at least one embodiment, the semiconductor components or at least some of the semiconductor components are mounted so as to be movable relative to the reflective surface. This renders it possible for a spectral and/or spatial directional characteristic of the ring light module to be variable and/or adjustable by varying a relative position between the semiconductor components and the reflective surface. A corresponding displacement between the semiconductor components and the reflective surface can be achieved e.g. by means of electrically operable motors, by pressure changes or by thermally induced movement, for instance by means of bimetals.

In accordance with at least one embodiment, the reflective surface is configured as an adaptive optics. That is to say, the shape of the reflective surface is variable in a controlled manner. For example, the reflective surface in its entirety can be changed from planar to concavely or to convexly curved and vice versa. It is likewise possible for the reflective surface to be subdivided into a multiplicity of segments or facets which can be actuated individually or in groups. The individual facets can be actuated e.g. via piezo actuators. The reflective surface can then be a Fresnel optics.

In accordance with at least one embodiment, the ring light module is free of a diffuser which is configured for scattering radiation. In particular, the ring light module then does not have any castings or plates provided therein, into which scattering particles are embedded. The ring light module can thus be free of components for the controlled scattering of light.

In accordance with at least one embodiment, the semiconductor components are arranged in two or in more than two rows on the carrier and/or around the reflective surface. The rows follow one another in particular in the direction perpendicular to the main radiation side. The rows can comprise identical or even mutually different average diameters.

In accordance with at least one embodiment, the main emission directions of the semiconductor components or at least some of the semiconductor components or of the semiconductor components in one row point towards a base side of the ring light module. The base side is e.g. a mounting side of the ring light module and is preferably opposite to the main radiation side. An angle between the main emission directions and the base side is then e.g. between 45° and 90° or between 60° and 80°.

Alternatively, it is also possible for the main emission directions of all or some of the semiconductor components to be oriented in parallel with the main radiation side or to point towards the main radiation side. It can also be the case that some of the semiconductor components are oriented in such a manner that the main emission directions thereof point towards the base side and that some other semiconductor components comprise main emission directions in parallel with or towards the main radiation side.

In accordance with at least one embodiment, the ring light module includes a cover plate. The cover plate is located preferably on the main radiation side and can form the main radiation side. For example, the cover plate is formed from a radiolucent, transparent material. Furthermore, optically effective layers such as filter layers or anti-reflective layers can optionally be attached to the cover plate.

In accordance with at least one embodiment, the ring light module comprises one or a plurality of conversion means for partly or completely converting the wavelength of a radiation generated by the semiconductor components. Preferably, the ring light module emits a mixed radiation consisting of light emitted directly by the semiconductor components and of light from the conversion means.

In accordance with at least one embodiment, the conversion means is attached to the reflective surface and/or to the cover plate. The cover plate and the reflective surface can be partly or completely covered by the conversion means. If the ring light module comprises a plurality of semiconductor components which emit in different spectral ranges, it is possible for the conversion means to function as a conversion means for a first radiation from semiconductor components, e.g. for blue light and to be optically neutral or to function as a scattering means for a second radiation, e.g. for red light.

In accordance with at least one embodiment, the reflector is semitransparent and/or chromatically selectively reflective. For example, the reflector and/or the reflective surface then comprise(s) a reflectivity for the entire spectral ranges or for specific spectral ranges of the radiation, which is emitted by the semiconductor components, between 30% and 70% inclusive. It is also possible for the reflector to reflect e.g. blue light and to transmit red light or vice versa. The light transmitted by the reflector preferably undergoes refraction upon entering and exiting the reflector.

In accordance with at least one embodiment, the reflective surface is formed from two or more than two facets. Preferably, the facets are separated from one another by edges. It is possible for adjacent facets not to have any continuous material connection.

In accordance with at least one embodiment, the ring light module comprises at least five or at least six or at least eight or at least twelve or at least 16 semiconductor components. Alternatively or in addition, the ring light module includes at the most 50 or at the most 32 or at the most 24 semiconductor components.

In accordance with at least one embodiment, an average diameter of the reflective surface, as seen in plan view of the main radiation side, is at least 5 mm or at least 8 mm. The average diameter can be at the most 50 mm or at the most 30 mm. Furthermore, the reflective surface preferably comprises a maximum extension in the direction perpendicular to the main radiation side of at least 2 mm or at least 4 mm or at least 6 mm. Likewise, this maximum extension can be at the most 50 mm or at the most 30 mm or at the most 20 mm or at the most 15 mm or at the most 12 mm.

In accordance with at least one embodiment, the semiconductor components or at least some of the semiconductor components are configured for generating a lighting current of at least 50 lm in normal use. This applies in particular to semiconductor components which emit blue light or white light or yellow light.

In accordance with at least one embodiment, at least 50% or at least 80% or at least 90% of the radiation generated by the semiconductor components impinges upon the reflective surface. This applies in particular to radiation generated directly by the semiconductor components. A definitive beam formation of the light emitted by the ring light module can thus be effected with the reflective surface.

In accordance with at least one embodiment, a proportion of at least 50% or at least 80% or at least 90% of the radiation which impinges upon the reflective surface and is generated by the semiconductor components passes to the main radiation side after being reflected only once at the reflective surface. A major proportion of the radiation thus passes directly from the semiconductor components to the reflective surface and then leaves the ring light module directly.

In accordance with at least one embodiment, the ring light module comprises a lens. The lens is arranged downstream of the main radiation side or the lens forms the main radiation side. In particular, the lens is formed from transparent, radiolucent material.

In accordance with at least one embodiment, the lens is a collecting lens. The lens comprises in particular a convex, planar-convex or biconvex shape.

In accordance with at least one embodiment, the lens comprises a central minimum on a lens upper side facing away from the reflector. Furthermore, the lens can have a circumferential minimum on a lens underside facing towards the reflector.

In accordance with at least one embodiment, the lens acts to form beams both by refraction and by reflection. For example, total reflection or merely partial transmission is effected for a portion of the radiation at the lens. For example, a portion of the radiation emitted by the semiconductor components is directed in the direction away from the lens upper side. This radiation proportion preferably does not pass through the lens or only some of it passes therethrough.

In accordance with at least one embodiment, the ring light module is configured for radiation at two mutually opposite main sides. For example, two of the reflectors of the ring light module are then oriented anti-parallel with respect to one another and, as seen in plan view of one of the main sides, are arranged preferably in a congruent manner one on top of the other. The two reflectors can be formed identically to or differently from one another, for instance with mutually different average curvatures.

A ring light module described herein will be explained in greater detail hereinafter with reference to the drawing using exemplified embodiments. Like reference numerals designate like elements in the individual figures. However, none of the references are illustrated to scale; instead, in order to improve understanding, individual elements can be illustrated excessively large.

DETAILED DESCRIPTION

Figure 1:
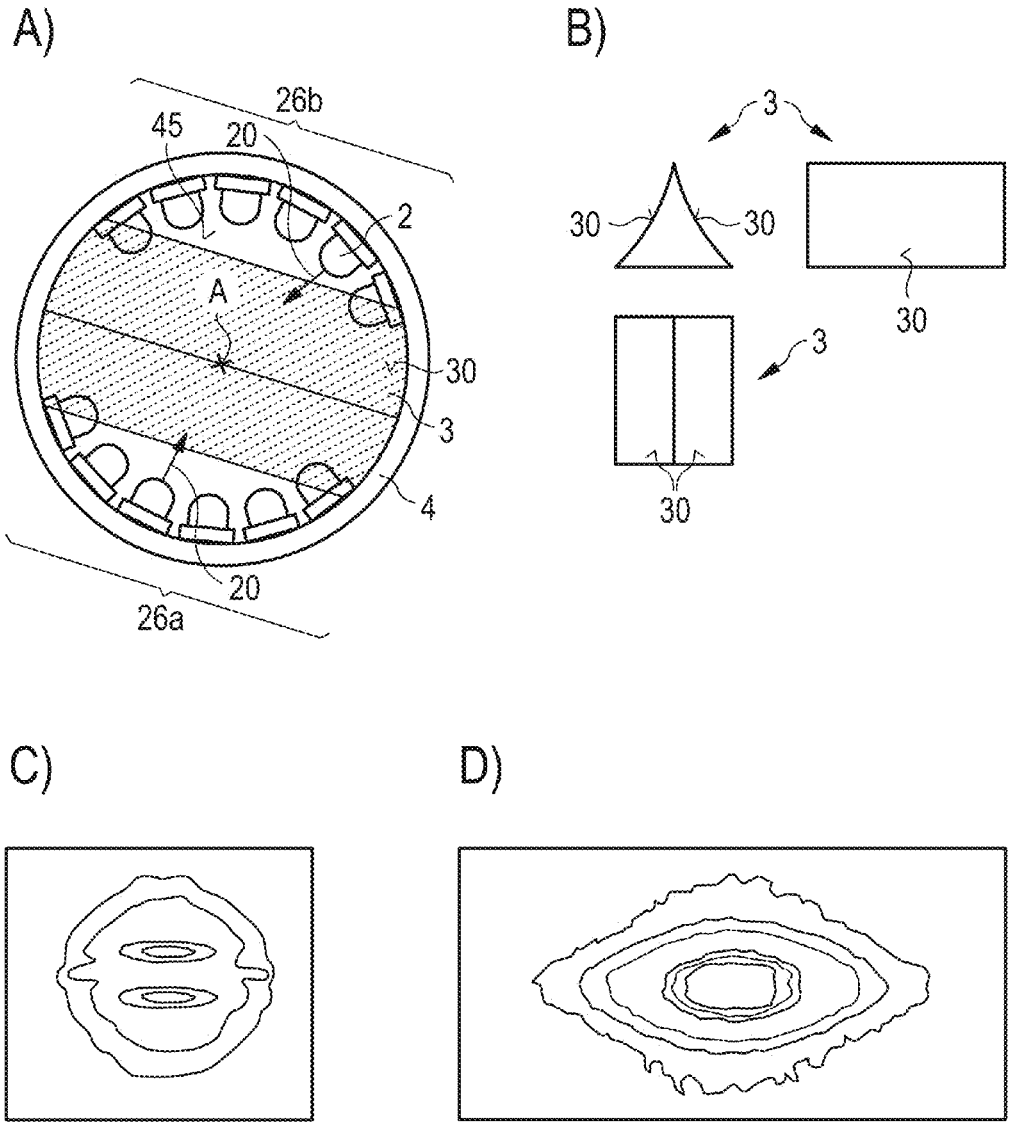
FIGS. 1 to 9 show schematic views of exemplified embodiments of ring light modules described herein.

FIG. 1A shows a schematic plan view of an exemplified embodiment of a ring light module 1. The ring light module 1 comprises a plurality of optoelectronic semiconductor components 2, in particular light-emitting diodes. The semiconductor components 2 are attached in two partial circular arcs 26*a*, 26*b* to a tubular carrier 4. The carrier 4 functions preferably as a heat sink and cooling body for the semiconductor components 2. For example, the carrier 4 is formed by a metal core printed board, a printed circuit board or by an extrusion-coated leadframe.

A reflector 3 having a reflective surface 30 is provided inside the carrier 4. The reflector 3 is illustrated in FIG. 1B in a schematic front view, a schematic side view and a schematic plan view. The reflector 3 comprises a triangular cross-section, wherein the reflective surfaces 30 can be formed to be straight, concave or convex. The reflector 3 is thus prismatic or approximately prismatic.

The ring light module 1 comprises an axis of symmetry A. The partial circular arcs 26*a*, 26*b* and the carrier 4 comprise as a centre point the axis of symmetry A, as seen in plan view of a main radiation side 45 of the ring light module 1. The main radiation side 45 is a notional surface which covers the reflector 3, the carrier 4 and the semiconductor components 2.

As also seen in plan view, the ring light module 1 comprises two planes of symmetry which are oriented perpendicularly with respect to one another and extend through the axis of symmetry A. The six semiconductor components 2 in each of the partial circular arcs 26*a*, 26*b* face precisely towards one of the sides of the reflector 3. The reflector 3 comprises precisely two reflective surfaces 30.

FIG. 10 illustrates an intensity distribution in an optical near field of the radiation emitted by the ring light module 1 and FIG. 1D illustrates an intensity distribution in an optical far field of the radiation emitted by the ring light module 1. It can be seen in FIG. 10 that in the optical near field two strip-shaped intensity maxima occur. However, the optical far field has an ellipsoidal, more uniform intensity distribution having only one maximum.

As also in the case of all other exemplified embodiments, it is possible that the semiconductor components 2 are each identically constructed within production tolerances and emit radiation of an identical spectral composition, in particular white light. Likewise, semiconductor components 2 which emit different colours can be combined with one another and can follow one another alternately, e.g. semiconductor components which emit white light and semiconductor components which emit red light. Furthermore, a spectral composition of the light emitted by the semiconductor components 2 in the partial circular arc 26*a* can deviate from the spectral composition of the radiation which is emitted by the semiconductor components 2 in the partial circular arc 26*b*. This can also apply to a lighting current.

As shown in FIG. 1A, the semiconductor components 2 each comprise a lens for beam formation. The lens can be formed to be rotationally symmetrical or even asymmetrical, e.g. oval.

The lenses of the semiconductor components 2 can be configured to be different from one another in the partial circular arcs 26*a*, 26*b*. Alternatively, it is possible for the semiconductor components 2 to be free of lenses. The semiconductor components 2 can each comprise a conversion means for converting wavelengths.

Figure 2:
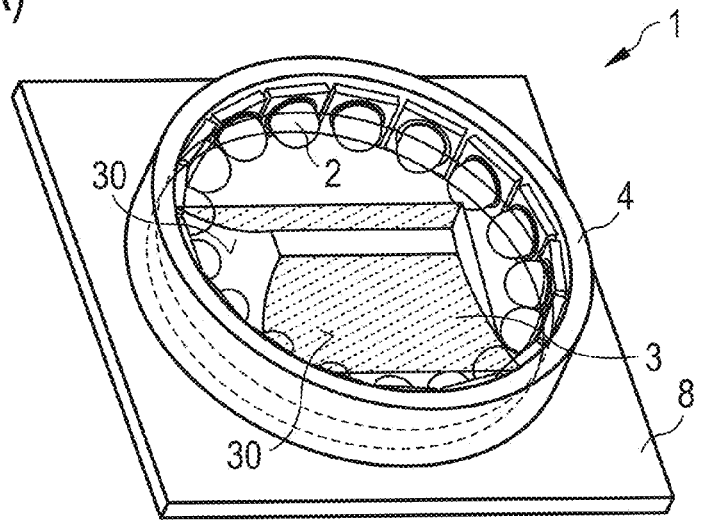
Figure 2:
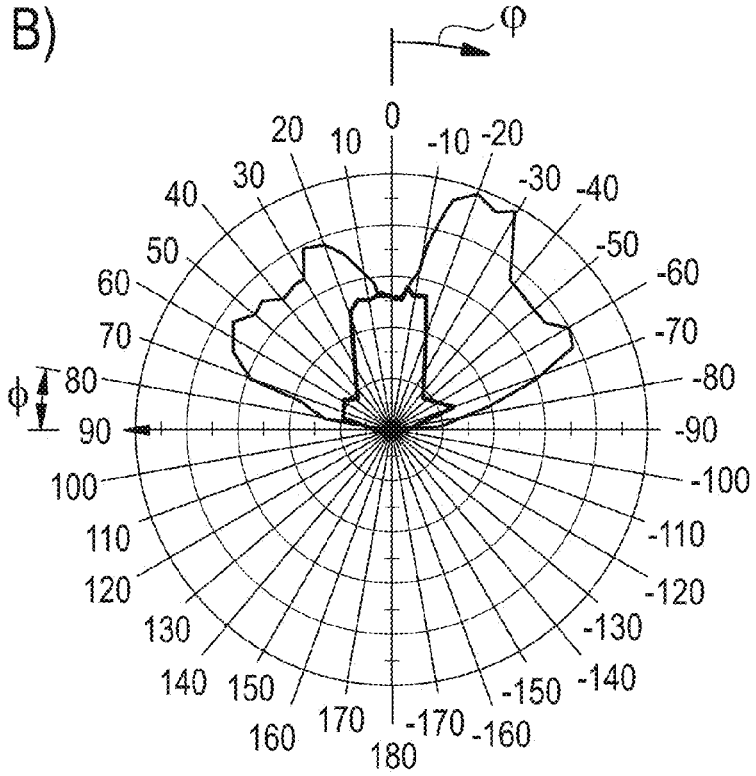

A further exemplified embodiment of the ring light module 1 is shown in a perspective view in FIG. 2A. In contrast to FIG. 1A, the semiconductor components 2 are arranged close together along a single closed line. A spaced interval between adjacent semiconductor components 2 is small in comparison with average lateral dimensions of the semiconductor components 2. As seen in plan view, the ring light module 1 comprises precisely two planes of symmetry.

The reflector 3 comprises four reflective surfaces 30. In contrast to FIG. 1A, end sides of the reflector 3 thus also form reflective surfaces 30.

The semiconductor components 2 can be actuated individually or in groups, preferably independently of one another, so that it is possible to switch between a daytime driving setting, full beam setting and dipped setting in a headlight for a motor vehicle. The ring light module 1 can thus be used in a motor vehicle headlight.

The carrier 4 is mounted on a cooling body 8 which also forms a base plate of the ring light module 1. Optionally, sidewalls of the carrier 4 and an upper side of the cooling body 8 facing towards the reflector 3 can be configured to be reflective.

FIG. 2B illustrates a lighting current $\Phi$ plotted against an angle of radiation $\phi$ along two orthogonal directions. Along one of the spatial directions, radiation is effected in only one comparatively small angle range with a half-value angle of approximately 40°. In the direction perpendicular thereto, the emission is effected over a large angle range of approximately 140°. An asymmetrical directional characteristic can thus be adjusted by the reflector 3.

Figure 3:
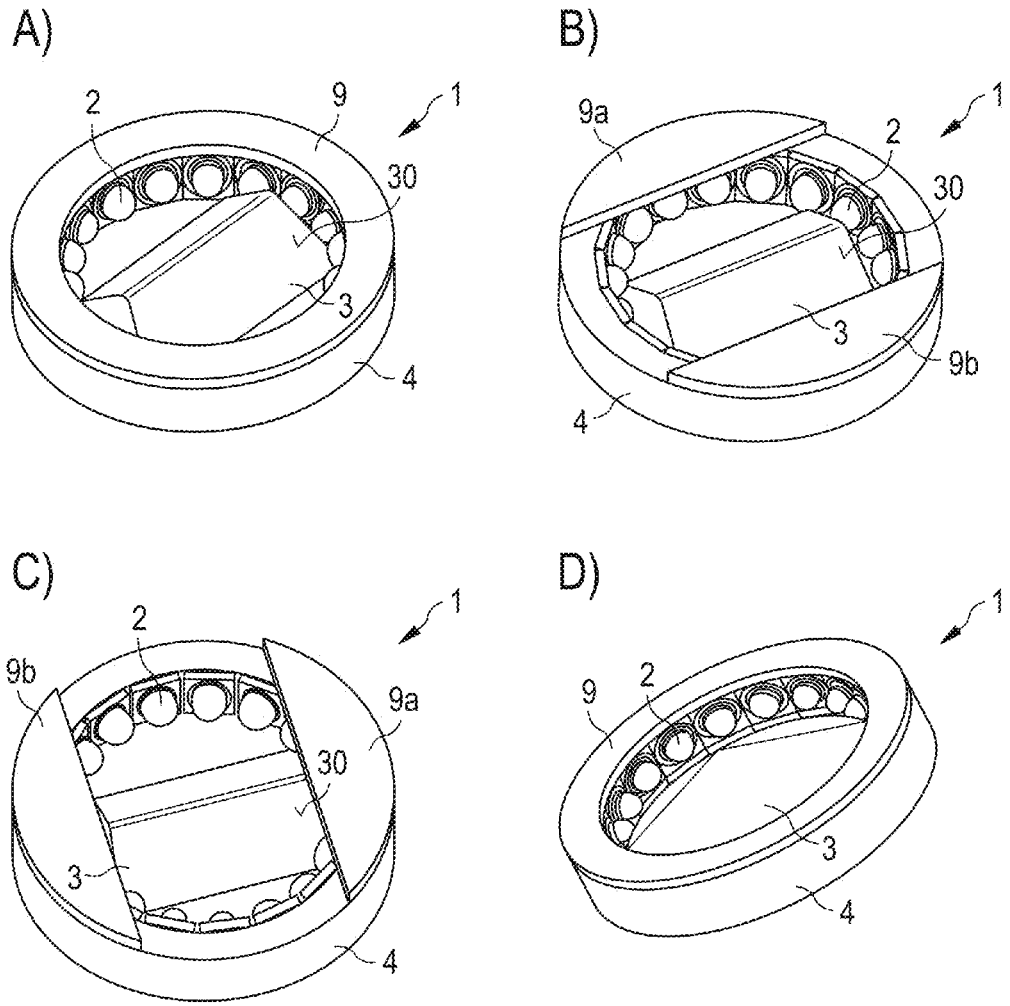

FIG. 3 shows further exemplified embodiments of the ring light module 1 as perspective views. The arrangement of the semiconductor components 2 corresponds in each case to that shown in FIG. 2A. In contrast, it is also possible to use an arrangement of the semiconductor components 2, as stated in conjunction with FIG. 1A.

The ring light module 1, as shown in FIG. 3A, comprises a screen 9 which completely covers the semiconductor components 2, as seen in plan view. The screen 9 is formed in a rotationally symmetrical manner as a disk.

In the case of the exemplified embodiment shown in FIG. 3B, the screen comprises two parts 9*a*, 9*b* which are separated from one another. The parts 9*a*, 9*b* are oriented in parallel with a longitudinal axis of the reflector 3. The parts 9*a*, 9*b* cover only some of the semiconductor components 2, as seen in plan view. In contrast, in FIG. 3C the parts 9*a*, 9*b* of the screen are oriented transversely with respect to the longitudinal axis of the reflector 3.

In the variation shown in FIG. 3D, the reflector 3 is formed in a rotationally symmetrical manner and the semiconductor components 2 are likewise arranged in a rotationally symmetrical manner.

Corresponding screens can also be used in all of the other exemplified embodiments.

Figure 4:
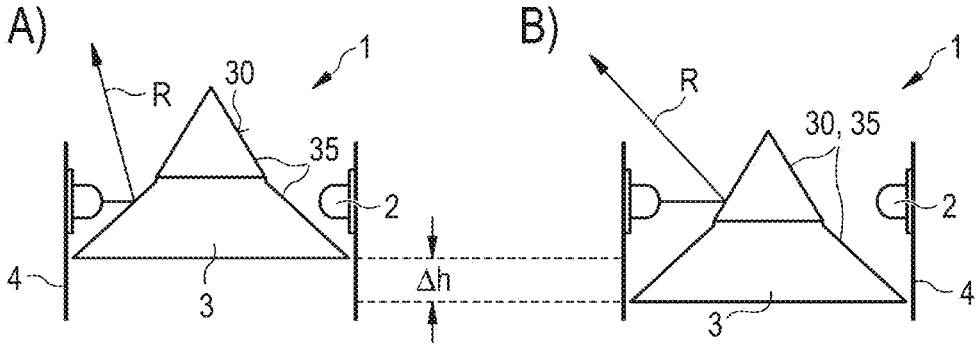

In the case of the exemplified embodiment of the ring light module 1 shown in FIG. 4, the reflector 3 is mounted so as to be displaceable relative to the semiconductor components 2. A displacement path Ah is illustrated schematically comparing FIGS. 4A to 4B.

The reflector 3 comprises two facets 35 which form the reflective surface 30. Depending upon the position of the semiconductor components 2 relative to the reflector 3, a major proportion of the radiation R which is generated by the semiconductor components 2 impinges upon a lower or an upper one of the facets 35. As a result, a directional characteristic of the ring light module 1 can be adjusted.

A corresponding displacement of the reflector 3 relative to the semiconductor components 2 can also be used in all of the other exemplified embodiments of the ring light module 1.

Figure 5:
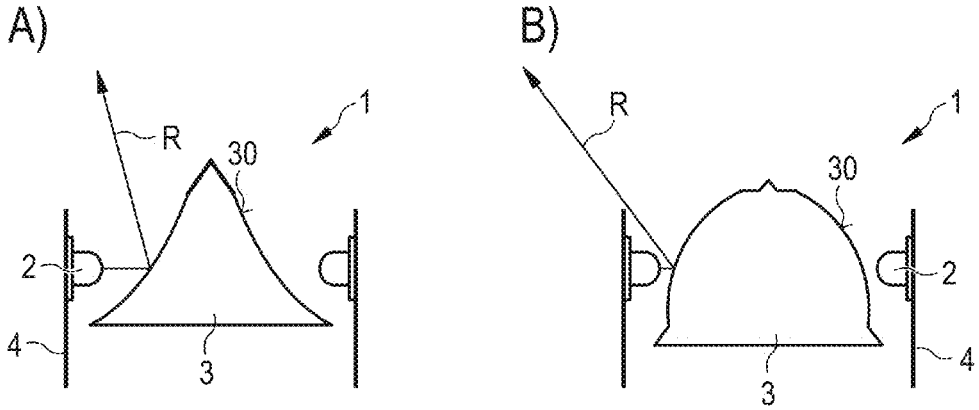

In the case of the exemplified embodiment as shown in FIG. 5, the shape of the reflective surface 30 is variable. In FIG. 5A, the reflective surface 30 comprises a convex shape when viewed from the semiconductor components 2. The semiconductor components 2 can be located in a focal line of the reflector 3. However, as shown in FIG. 5B the reflective surface 30 is formed in a concave manner.

By varying the shape of the reflective surface 30, the directional characteristic can be adjusted. The shape of the reflective surface 30 is varied for instance by a motor or by a gas pressure or by a hydraulic pressure. The reflective surface 30 can thus be formed in a flexible manner, similar to a rubber skin, and can form in particular continuously different reflector profiles. This is rendered possible e.g. by a thin metal foil on a substructure or by corresponding mechanics having a splaying mechanism similar to that in a dowel.

Figure 6:
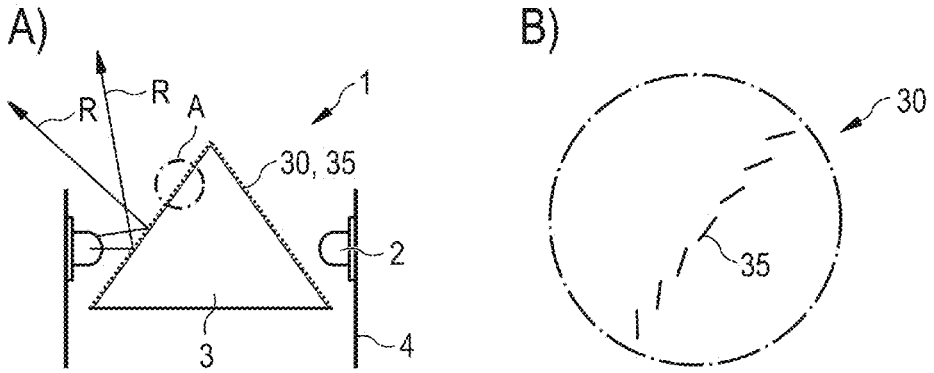

In the exemplified embodiment of the ring light module 1 as shown in FIG. 6A, the reflective surface 30 is formed from a multiplicity of individually actuatable facets 35, cf. section A in FIG. 6B. The reflective surface 30 can be assembled from the individual facets 35 and is constructed in a similar manner to a Fresnel optics. As seen in cross-section, a basic shape of the reflector 3, triangular as shown in FIG. 6A, is approximately constant. The directional characteristic is changed only at the level of the facets 35, in contrast to FIG. 5.

The individual flanks 35 is actuated e.g. by piezo elements or by micro-electromechanical systems, abbreviated as MEMS. An angle of the individual facets 35 can also be adjusted in a particularly continuous manner during ongoing operation of the ring light module 1.

Figure 7:
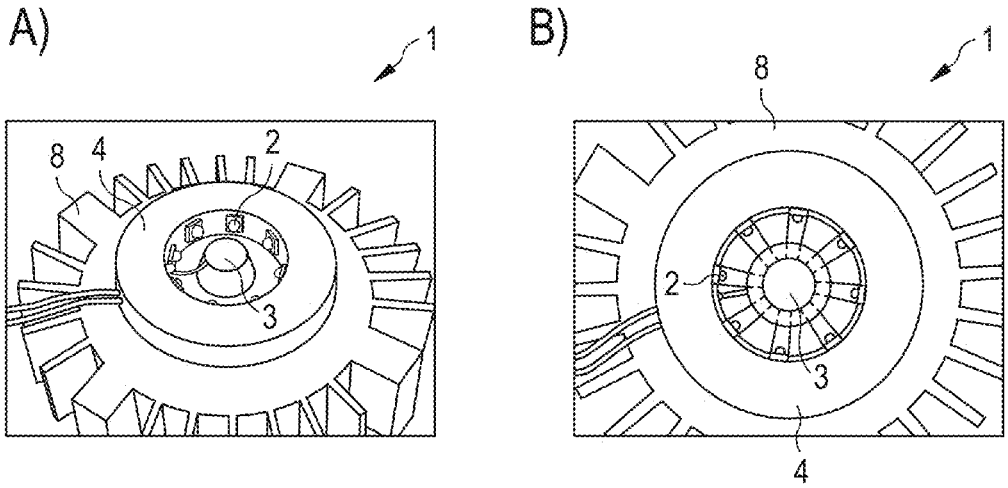

In the case of the exemplified embodiment, as shown in perspective views in FIGS. 7A and 7B, the cooling body 8 is provided with a multiplicity of cooling ribs around the carrier 4. The semiconductor components 2 are arranged in a rotationally symmetrical manner around the reflector 3 and comprise a relatively small spaced interval with respect to one another.

Figure 8:
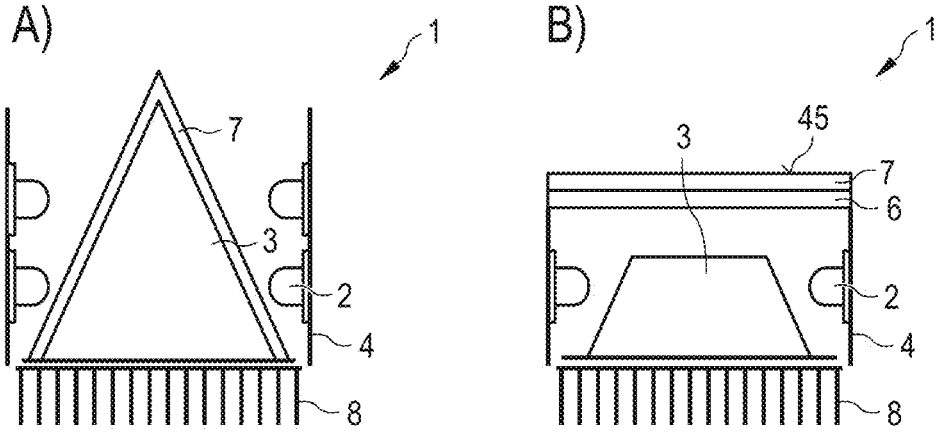

A further exemplified embodiment of the ring light module 1 is shown in FIG. 8A. As in all of the other exemplified embodiments, it is possible for the semiconductor components 2 to be arranged in a plurality of rows on the carrier 4 around the reflector 3. As is also preferably the case in all of the other exemplified embodiments, the reflector 3 does not produce any direct line of sight between mutually opposite semiconductor components 2.

Optionally, as is also the case in all of the other exemplified embodiments, a conversion means 7 for at least partial conversion of wavelengths is attached to the reflector 3. In contrast to the illustration, the conversion means 7 can be restricted to specified locations of the reflector 3. The conversion means 7 is arranged spaced apart from the semiconductor components 2.

As shown in FIG. 8B, the reflector 3 is formed in a trapezoidal manner as seen in cross-section. Furthermore, as shown in FIG. 8B the ring light module 1 comprises a cover plate 6. Optionally, the conversion means 7 is attached to the cover plate 6. In contrast to the illustration, the conversion means 7 can also be attached to a side of the cover plate 6 facing towards the reflector 3. Corresponding conversion means 7 and cover plates 6, as illustrated in conjunction with FIGS. 8A and 8B, can also be implemented in all of the other exemplified embodiments.

Figure 9:
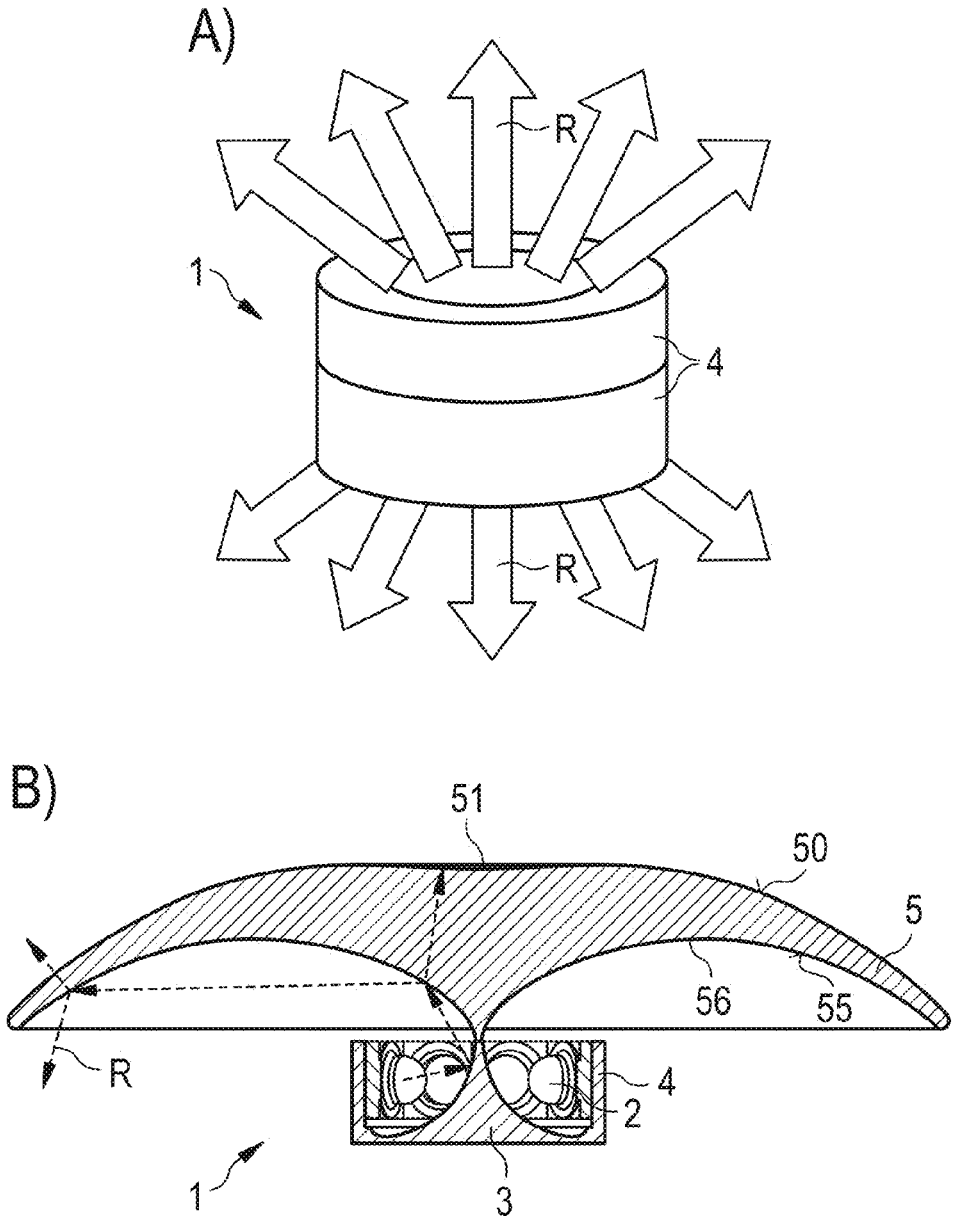

In the case of the exemplified embodiment shown in FIG. 9A, two carriers 4 having the associated semiconductor components and reflectors, not shown, are arranged one on top of the other. As a result, the radiation R can be emitted on both sides.

In FIG. 9B, the ring light module 1 additionally comprises a lens 5. The radiation R can also be distributed in a direction opposite to a main radiation direction of the ring light module 1 by means of the lens 5. The lens 5 acts to form beams both by refraction and by reflection. A portion of the radiation R does not pass through the lens 5.

The lens 5 comprises a central minimum on an upper side 50 facing away from the reflector 3. An annular circumferential minimum 56 is located on an underside 55 of the lens 5.

The invention described herein is not limited by the description using the exemplified embodiments. Rather, the invention includes any new feature and any combination of features included in particular in any combination of features in the claims, even if this feature or this combination itself is not explicitly stated in the claims or exemplified embodiments.

This patent application claims the priority of German patent application 10 2012 109 145.5, the disclosure content of which is hereby incorporated by reference.

The invention claimed is:

1. A ring light module, comprising:

a plurality of optoelectronic semiconductor components for generating an electromagnetic radiation;

a reflector having a reflective surface; and a carrier to which the optoelectronic semiconductor components are attached, wherein the reflector, as seen in plan view of a main radiation side of the ring light module, comprises at the most two planes of symmetry, wherein the reflector tapers in the direction towards the main radiation side, wherein main emission directions of adjacent optoelectronic semiconductor components are oriented, at least in part, differently from one another, wherein the main emission directions point towards the reflective surface, wherein the optoelectronic semiconductor components are arranged close together along a single closed circular line so that an average spaced interval between adjacent optoelectronic semiconductor components is at the most 0.75 times an average diameter of the optoelectronic semiconductor components, wherein when seen in top view, the ring light module comprises precisely two planes of symmetry, wherein the reflector comprises four reflective surfaces, namely two main sides and two end sides, all four sides being designed to reflect radiation in operation of the device, the reflector comprising a triangular or trapezoidal cross-section, the main sides being formed to be concave or convex entirely, and wherein there is no direct line of sight between optoelectronic semiconductor components arranged diametrically around the single closed circular line.

2. The ring light module according to claim 1, further comprising at least one screen, wherein at least some of the optoelectronic semiconductor components are covered by the screen, as seen in plan view of the main radiation side.

3. The ring light module according to claim 2, wherein the at least one screen is segmented and does not cover all of the optoelectronic semiconductor components, as seen in plan view of the main radiation side.

4. The ring light module according to claim 1, wherein the main emission directions of at least some of the optoelectronic semiconductor components point towards a base side, and wherein the base side is a mounting side of the ring light module and is opposite to the main radiation side.

5. The ring light module according to claim 1, wherein a conversion means for partially converting the wavelength of the electromagnetic radiation emitted by the optoelectronic semiconductor components is attached to a cover plate on the main radiation side and/or to the reflective surface, and wherein the conversion means is arranged spaced apart from the optoelectronic semiconductor components.

6. The ring light module according to claim 1, wherein the reflector is semitransparent and/or chromatically selectively reflective.

7. The ring light module according to claim 1, wherein the reflective surface is formed from at least two facets, and wherein the facets are separated from one another by edges.

8. The ring light module according to claim 1, comprising between 8 and 32 optoelectronic semiconductor components inclusive, wherein an average diameter of the reflective surface is between 5 mm and 50 mm inclusive, wherein a maximum extension of the reflective surface in a direction perpendicular to the main radiation side is between 2 mm and 50 mm inclusive, wherein the optoelectronic semiconductor components are configured for generating a lighting current of at least 50 lumens in normal use, wherein at least 50% of the electromagnetic radiation generated by the optoelectronic semiconductor components impinges upon the reflective surface, wherein a proportion of at least 80% of the electromagnetic radiation which impinges upon the reflective surface, after being generated by the optoelectronic semiconductor components, passes to the main radiation side after being reflected only once at the reflective surface, and wherein the reflective surface is concavely or convexly curved.

9. The ring light module according to claim 1, wherein a lens is arranged downstream of the main radiation side, wherein the lens is radiolucent, wherein a lens upper side facing away from the reflector comprises a central minimum, wherein a lens underside facing towards the reflector comprises a circumferential minimum, wherein the lens acts to form beams both by refraction and by reflection, and wherein a portion of the radiation emitted by the optoelectronic semiconductor components is directed by the lens in the direction away from the lens upper side and this portion of the radiation does not pass through the lens.

10. The ring light module according to claim 1, wherein the optoelectronic semiconductor components are arranged in a rotationally symmetrical manner close together around the reflector along the closed line, and wherein the carrier is formed in a rotationally symmetrical manner, as seen in plan view of the main radiation side.

11. A ring light module, comprising:

a plurality of optoelectronic semiconductor components for generating electromagnetic radiation;

a reflector having at least one reflective surface;

a carrier to which the optoelectronic semiconductor components are attached; and at least one screen, wherein the reflector, as seen in plan view of a main radiation side of the ring light module, comprises at the most two planes of symmetry, wherein the reflector tapers in a direction towards the main radiation side, wherein main emission directions of adjacent optoelectronic semiconductor components are oriented, at least in part, differently from one another, and wherein the main emission directions point towards the at least one reflective surface, wherein the optoelectronic semiconductor components are arranged in at least two partial circular arcs around the reflector and follow one another closely within the partial circular arcs, and wherein the carrier is formed in a rotationally symmetrical manner and the partial circular arcs and the carrier comprise the same axis of rotation, as seen in plan view of the main radiation side, wherein there is no direct line of sight between optoelectronic semiconductor components arranged diametrically around the reflector, wherein the reflector comprises a triangular cross-section, the at least one reflective surface being smooth and formed to be concave or convex entirely, wherein when seen in top view, the optoelectronic semiconductor components comprise exactly two arcs having different main emission directions, and at least one of the optoelectronic semiconductor components in each arc overlap with the at least one reflective surface, wherein when seen in plan view of the main radiation side, at least some of the optoelectronic semiconductor components are covered by the at least one screen, and the at least one screen is segmented and does not cover all of the optoelectronic semiconductor components, and wherein when seen in top view, two parts of the screen which are separated from one another are oriented in parallel with a longitudinal axis of the reflector and cover only some of the optoelectronic semiconductor components.

12. The ring light module according to claim 11, wherein the optoelectronic semiconductor components or groups of the optoelectronic semiconductor components can be electrically operated independently of one another, and wherein a spatial directional characteristic of electromagnetic radiation output from the ring light module can be adjusted by selectively operating at least some of the optoelectronic semiconductor components.

13. The ring light module according to claim 11, wherein the optoelectronic semiconductor components are mounted so as to be movable relative to the at least one reflective surface, and a directional characteristic of electromagnetic radiation output from the ring light module can be varied by varying the relative position between the optoelectronic semiconductor components and the at least one reflective surface.

14. The ring light module according to claim 11, wherein the at least one reflective surface is configured as an adaptive optics and the shape thereof is variable in a controlled manner.

15. The ring light module according to claim 11, which is free of a diffuser which is configured for scattering radiation generated in the ring light module.

16. The ring light module according to claim 11, wherein the optoelectronic semiconductor components are arranged in at least two rows around the at least one reflective surface.

* * * * *